United States Patent [19]

Lewis

[11] 4,307,278

[45] Dec. 22, 1981

[54] CONTROL DEVICE FOR PARALLEL INDUCTION HEATING COILS

[75] Inventor: John C. Lewis, Wentworth, Canada

[73] Assignee: Park-Ohio Industries, Inc., Cleveland, Ohio

[21] Appl. No.: 111,210

[22] Filed: Jan. 11, 1980

[51] Int. Cl.[3] ..... H05B 9/02

[52] U.S. Cl. ..... 219/10.75; 13/27; 219/10.79; 219/10.77; 336/137

[58] Field of Search ..... 219/8.5, 10.41, 10.49, 219/10.69, 10.71, 10.75, 10.77, 10.79; 13/26, 27; 336/115, 137; 338/316

[56] References Cited

U.S. PATENT DOCUMENTS

| | | | |
|---|---|---|---|
| 2,470,443 | 5/1949 | Mittelmann | 219/10.77 |
| 2,858,406 | 10/1958 | Boyd et al. | 219/10.75 |
| 3,419,792 | 12/1968 | Kasper et al. | 219/10.77 X |
| 3,431,382 | 3/1969 | Esche et al. | 219/10.79 |
| 3,475,674 | 10/1969 | Porterfield et al. | 219/10.75 X |
| 3,649,804 | 3/1972 | Kasper | 219/10.75 |
| 3,657,506 | 4/1972 | Aronson | 219/10.75 |
| 4,039,794 | 8/1977 | Kasper | 219/10.49 |
| 4,093,839 | 6/1978 | Moliterno et al. | 219/8.5 |
| 4,114,010 | 9/1978 | Lewis | 219/10.41 |
| 4,122,321 | 10/1978 | Cachat | 219/10.41 |

*Primary Examiner*—Volodymyr Y. Mayewsky

*Attorney, Agent, or Firm*—Meyer, Tilberry & Body

[57] ABSTRACT

A device for controlling the heat generated by induction coils in a multiple induction heating coil furnace. Multiple induction coils provide parallel cylindrical passages having axial lengths and fixed diameters through which elongated workpieces are movable in the axial direction. The axial length of one induction coil is fixed while the other coils have variable lengths as a result of an arrangement for altering the distance between first and second ends of the induction coils. Sensors detect the temperatures of workpieces within each induction coil and a comparison of the detected temperature reveals the difference between the variable and fixed axial length induction coils. The axial length of the coils are shortened in the event that the detected temperature is greater than that of the workpiece in the fixed axial length coil, and conversely, lengthened in the event that the detected temperature is less than that of a workpiece in the fixed axial length coil. Altering of the axial length of the induction coil may be accomplished either manually or by a motor-drive arrangement automatically responsive to the comparison of the temperature sensors and comprises moving a first end of the variable axial length induction coil relative to a fixed second end.

7 Claims, 5 Drawing Figures

FIG. 1
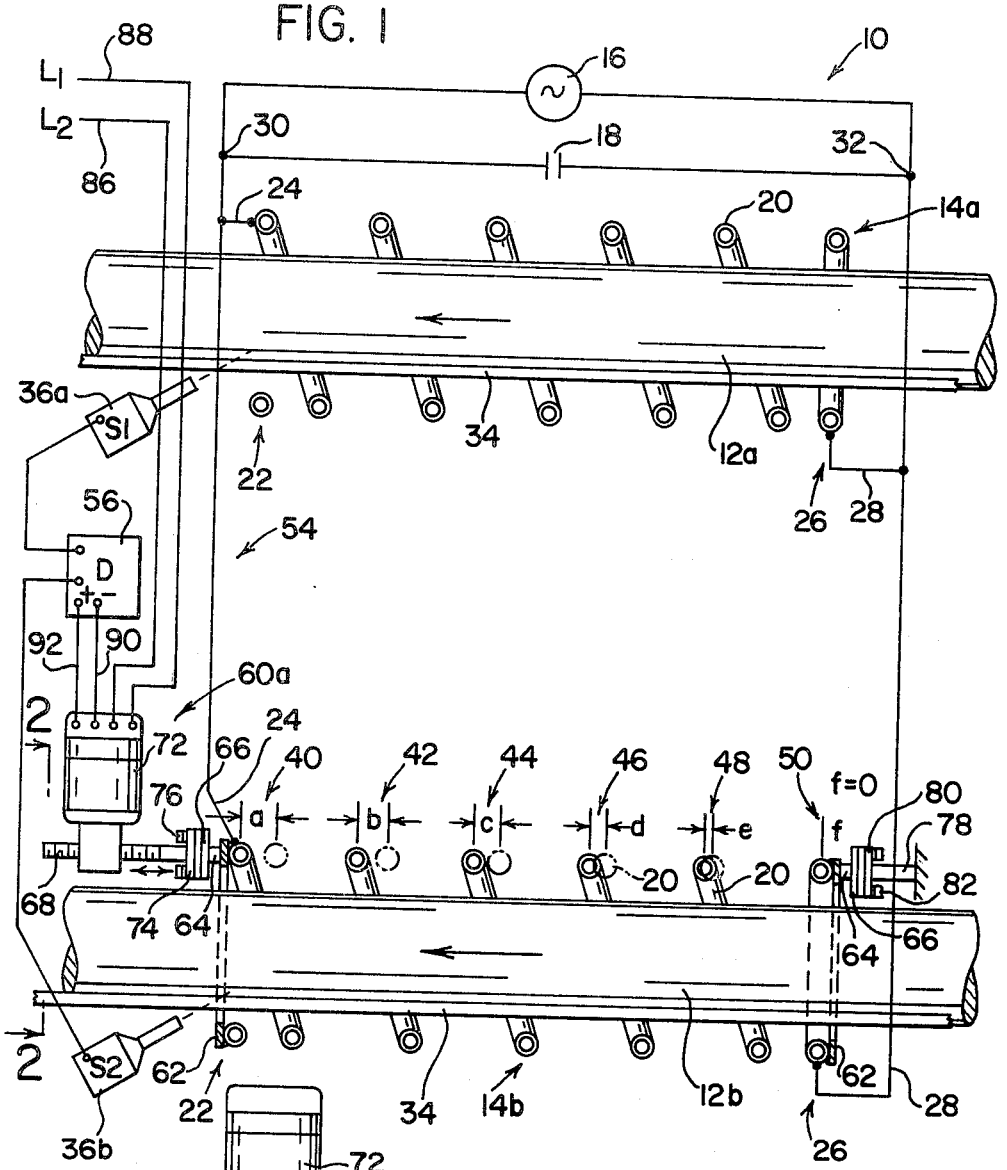
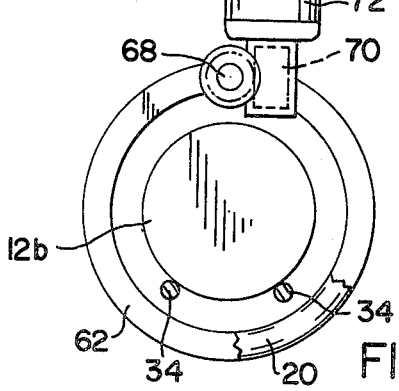
FIG. 2
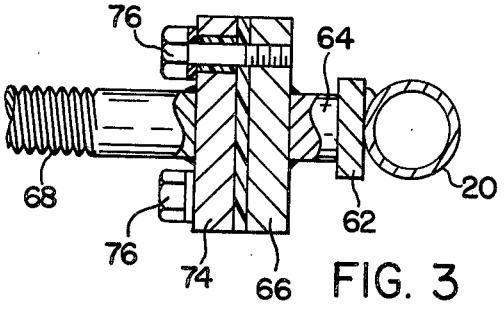
FIG. 3

CONTROL DEVICE FOR PARALLEL INDUCTION HEATING COILS

BACKGROUND OF THE INVENTION

The present invention relates to the art of induction heating and, more particularly, to an improved induction heating furnace which includes a control device for maintaining predetermined temperatures of heated workpieces in a multiple induction coil furnace.

The present invention is particularly applicable to inductively heating elongated or effectively continuous bar stock or elements to a processing temperature for subsequent forging, forming or treating; however, it should be appreciated that the invention has much broader applications and may be used for inductively heating various metal workpieces over a wide range of frequencies for various processing functions.

In metal stock treatment installations, consistency in the characteristics of completed articles is often required. Uniformity of the characteristics of forgings is particularly important with regard to the degree of quality and overall strength of a particular forging. Quality and strength of the eventual forged item are directly related to the temperature of the stock used for forging. Thus, in order to obtain identical characteristics of forged workpieces, the heating of the stock or billet, prior to forging, must be controlled to provide equal heating throughout the billet. A single induction heating furnace may be controlled to sequentially heat a number of billets to identical specifications. However, when a multiple induction heating furnace is required in order to heat more than one elongated bar, wherein a number of induction heating coils are arranged in electric parallel connection with a single power source, maintaining heating specifications for the bars is difficult. By providing induction heating coils of identical specifications, the parallel connection of the coils to a single power source necessitates equal power being applied at each induction coil. The application of equal power to a number of induction coils having similar characteristics would normally provide equal heating of workpieces extending through the induction coils. However, a number of further factors, variable for each of the parallel induction coils, effect the heating of a workpiece extending through the induction coils. These factors include the position of the workpiece within the coil, environmental conditions in the immediate vicinity of each coil, and most notably the slightly variable masses of the workpieces due to manufacturing tolerances.

The most common method of varying heating by individual induction coils of a multiple parallel arrangement at present involves the use of multiple tap induction coils. When the temperature of a workpiece is desired to be changed, one power source lead at the coil is disconnected and reconnected at a different tap along the coil. To increase the temperature of the workpiece the reconnection is made at a tap further along the coil, thus lengthening the coil. The temperature is decreased by reconnection of the lead at a tap which results in shortening the coil. Obviously, the use of multiple tap coils does not achieve infinite adjustability of the temperature within a coil. A slide variable tap coil is not practical as a result of the high currents required to be transferred to the coil for induction heating. Moreover, the operator intervention necessary to use multiple tap induction coils in disconnecting and reconnecting leads renders the process cumbersome at best.

Another technique used to equalize temperatures of multiple workpieces in parallel induction furnaces involves altering the speed at which one workpiece travels through the respective coil. While such an approach is acceptable in some situations, subsequent processing steps which require regulated delivery of the workpieces render speed control worthless.

SUMMARY OF THE INVENTION

The present invention relates to a furnace which employs multiple induction heating coils, supplied by a common electrical power supply, and controlled to provide uniform heating of multiple workpieces without the disadvantages of previous heating installations.

In accordance with the present invention there is provided an apparatus for heating a number of elongated workpieces, each having an elongated axis, moving along parallel heating paths in a selected linear direction wherein the heating paths are defined by cylindrical passages of fixed diameter and an axial length internal to the induction heating coils. The apparatus comprises a plurality of high permeability flux directing elements or induction coils connected together in electrical parallel with a common electrical power supply for the purpose of providing uniform electrical energy to each of the plurality of induction coils. The heat generated within each induction coil is controlled by sensing the temperature of a workpiece within the passage of each coil and adjusting a coil characteristic to achieve temperature equilibrium.

Induction heating occurs to a relatively large depth into the workpiece to cause direct heating of portions of the workpiece. In addition, the heat energy is conducted through the workpiece to cause temperature equilibrium within the workpiece so that the workpiece eventually attains a temperature required for the subsequent processing operation. The temperature may be in the general range of from 1800° to 2400° F. when the subsequent processing is a forging operation. Where coating of metal with a layer of polymeric material is the intended subsequent process, the appropriate temperature range is 300° to 400° F. While other processes may require differing temperature ranges, the critical factor for all processes involves maintaining the temperature of all the workpieces equal for any one particular process. If the characteristics of the finished product are to be maintained, equal temperatures of the workpieces at the processing station are necessary.

By varying one factor effecting the heating of each of the induction coils, all of the induction coils provide for identical results in finished workpieces. The induction coils each comprise a continuous electrical conductor arranged in a multitude of adjacent convolutions having a first open circular end and a second open circular end providing openings to the circular passage within the induction coil. The factor effecting the heating ability of each induction coil varied to correct for equal heating of workpieces within each induction coil passage is the length of the induction coil. This length corresponds to the linear distance between the first and second open circular ends of the coil.

In accordance with one preferred embodiment of the invention, the temperature adjustment is arranged to occur automatically. The sensed temperatures for each induction coil are compared and temperature difference signals are supplied to independent drive mechanisms associated with each coil.

The primary object of the present invention is the provision of an improved induction heating furnace for heating elongated workpieces to predetermined temperatures for subsequent processing.

Another object of the present invention is the provision of an improved induction heating furnace for heating elongated workpieces which includes a plurality of induction heating coils arranged in electrical parallel connection with a common electrical power supply for heating each of the plurality of workpieces to a predetermined uniform temperature.

Yet another object of the present invention is the provision of an induction heating furnace in which the temperatures of a plurality of elongated workpieces within separate parallel connected induction coils are sensed and compared, one of the detected temperatures being a predetermined control temperature for a workpiece, and in which a characteristic of one of the induction coils is varied depending upon the comparison of the detected temperatures to achieve a uniform heating of the workpieces.

A further object of the present invention is the provision of an induction heating furnace comprised of induction heating coils electrically connected in parallel for heating workpieces received therein, one of said coils having a fixed axial length and the others variable axial lengths automatically adjustable to achieve uniform heating of the workpieces in the coils.

BRIEF DESCRIPTION OF THE DRAWINGS

The invention may take physical form in a variety of parts and arrangements of parts, preferred embodiments of which will be described in the following specification and illustrated in the accompanying drawings which form a part hereof and where;

FIG. 1 is a side elevation view, partially in section, of an induction heating furnace constructed in accordance with the present invention including two parallel induction heating coils for simultaneously heating two elongated workpieces;

FIG. 2 is a cross-section view taken along line 2—2 of FIG. 1 illustrating a mechanism for varying the length of one induction heating coil;

FIG. 3 is an enlarged side elevation view, partially in section, of the mechanism shown in FIG. 2;

DESCRIPTION OF THE PREFERRED EMBODIMENTS

Figure 4:
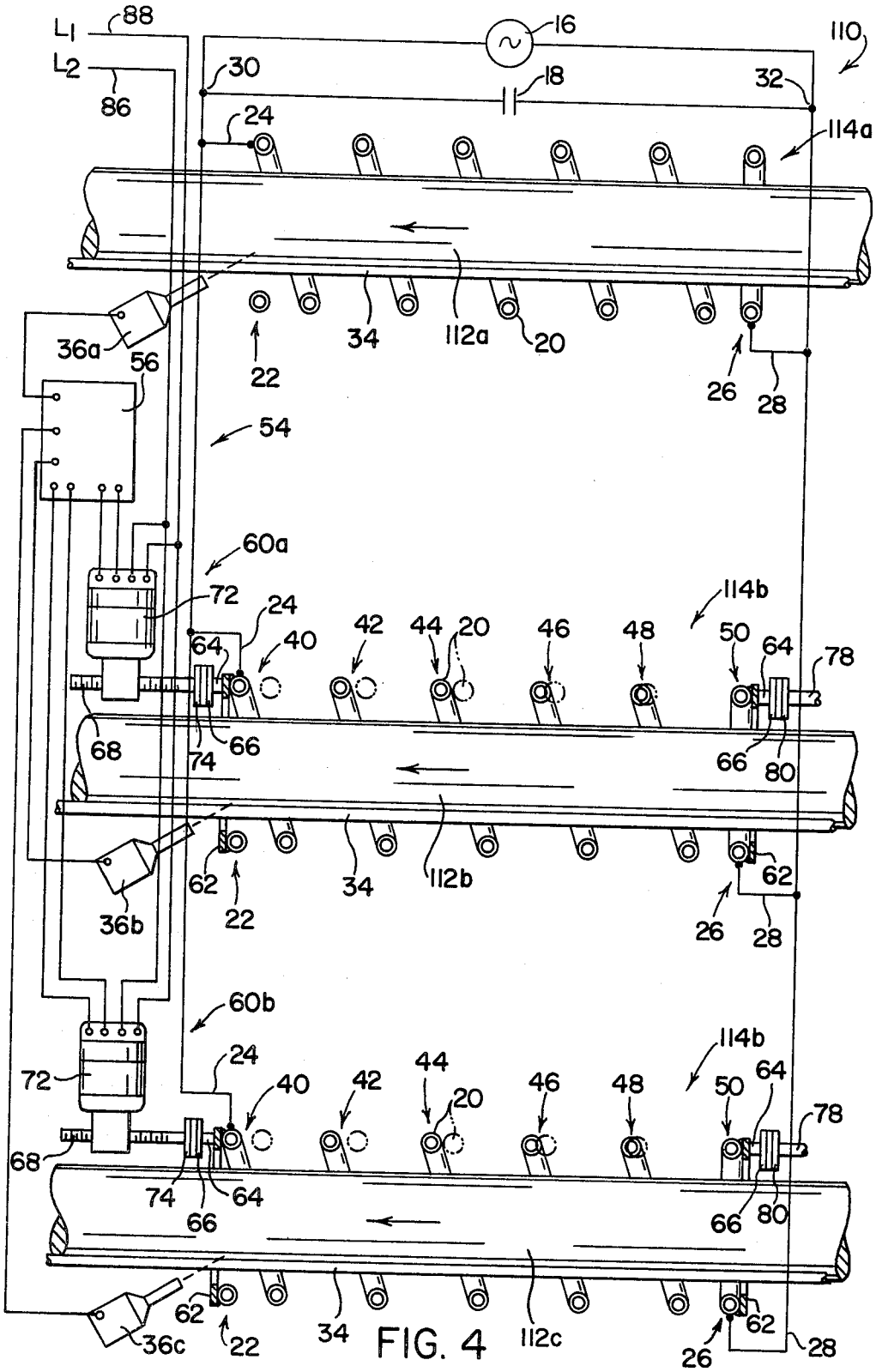
FIG. 4 is a side elevation view, partially in section, of another induction heating furnace constructed in accordance with the present invention and including a plurality of electrically parallel connected induction heating coils for heating a plurality of elongated workpieces; and, FIG. 5 is a side elevation view, partially in section, of another embodiment of an induction heating furnace constructed in accordance with the invention.

Referring now to the drawings wherein the showings are for the purpose of illustrating preferred embodiments of the invention only and not for the purpose of limiting the invention, FIG. 1 shows a furnace 10 for heating plural elongated workpieces 12*a* and 12*b*. Furnace 10 comprises plural induction heating coils 14*a* and 14*b* connected in electrical parallel arrangement with a power source 16. Also connected in electrical parallel arrangement with induction heating coils 14*a*, 14*b* and power source 16 is a power factor correction circuit 18, the construction and use of which is well known in the art for the purposes of minimizing electrical power costs by counteracting the effect of the inductive load of the heating coils with respect to the power supplied by source 16. Induction heating coils 14*a*, 14*b* are also generally well known in the art and each includes a tubular electrical conductor 20 formed into a multitude of electrically insulated, physically adjacent convolutions providing a cylindrically central passage having a fixed diameter within the convolutions. Each induction heating coil 14*a*, 14*b* includes a first circular end 22 from which an electrical lead 24 extends. A second circular end 26, at the opposite end of each of the induction coils, has an electrical lead 28 extending therefrom. The parallel connection of induction heating coils 14*a*, 14*b* to power source 16 is completed by connecting electrical lead 24 of each of the inductive heating coils to a power source lead 30 and, connecting electrical lead 28 from each of the induction heating coils to power source lead 32.

A series of rails 34, only one shown in each coil in FIG. 1, are provided in each induction heating coil 14*a*, 14*b*, for the purpose of guiding the workpieces through the induction heating coils. Workpieces 12*a*, 12*b* are moved through induction heating coils 14*a*, 14*b* through the use of any one of a number of well known devices specifically designed for such purposes, as for example a pushing ram (not shown). Normal operation of a furnace of the type depicted in FIG. 1 comprises the steps of workpieces 12*a*, 12*b* moving along rails 34 into and through the cylindrical passage of induction heating coils 14*a*, 14*b* and heating each workpiece to the desired temperature through energization of each induction heating coil by power source 16 as the workpiece moves through the coil. Parallel connection of induction heating coils 14*a*, 14*b* with single power source 16 theoretically assures equal power being applied to the induction heating coils if the reactance of the respective coils are assumed to be identical. Equal power supplied to identical coils results in equal heat produced by the coils, assuming all other factors to be identical. However, during the operation of a furnace such as that depicted in FIG. 1, environmental factors including the relative reactances of the induction heating coils are seldom identical. Thus, it will be appreciated that the provision of like coils connected in parallel does not assure the desired heating of workpieces 12*a* and 12*b*, to the same temperature.

In accordance with the present invention, control of induction heating coils 14*a* and 14*b* to maintain the temperature of workpieces 12*a* and 12*b* within the passages thereof at predetermined values is achieved through variation of a coil characteristic.

The purpose of the present invention is to achieve equality of temperatures through the intentional altering of a relevant factor concerning the heat generation of induction heating coils 14*a*, 14*b*. Generally, workpieces 12*a*, 12*b*, once moving through the cylindrical passages of the induction heating coils, operate as a conductor or core within an electro-magnet. In this respect, when an electrical current is supplied to induction heating coils 14*a*, 14*b*, an electromotive force is generated wherein a voltage is induced within the core or workpiece 12*a*, 12*b* of the induction heating coils.

The value of the inductance for any particular coil is related to the applied current according to the following equation:

$$L=(N\phi/10^8 I)$$

wherein:

L = inductance,
N = number of coil turns
I = current, and
$\phi$ = total flux of coil.

When current is provided through an induction coil, an electromotive force or voltage results according to the following equation:

$$V=2\pi fLI$$

wherein:

V = instantaneous generated electromotive force or voltage,
f = frequency,
L = inductance value, and
I = current.

Consideration of the first equation indicates that the inductance value varies directly with variations in the magnetic flux of the coil where the number of coil turns and current applied are maintained constant. While varying the number of turns of the coil is equivalent to providing multiple taps, as discussed hereinabove, varying the magnetic flux is accomplished by changing the length of the coil while maintaining the number of turns constant. As a result of supplying power to the induction coils from a single source arranged in electrical parallel with the coils, the voltage applied to each coil is identical. By fixing the voltage applied, the second equation requires the current to vary conversely with respect to the inductance to balance the equation. Thus, when the coil is lengthened or shortened causing the inductance to decrease or increase, correspondingly, the current must increase or decrease, respectively.

Heat generated in a workpiece within an induction coil passage is directly related to the power which is, in turn, directly related to the current through the equation:

$$P=I^2R$$

wherein:

P = power
I = current, and
R = resistance.

The end product of the above theory results in temperature increasing when the coil is lengthened, and temperature decreasing when the coil is shortened.

In accordance with the present invention, the heat generated within workpieces 12*a*, 12*b* can be regulated to provide uniformity and equality by the regulation of the magnetic flux generated by the coil. The magnetic flux is altered by increasing or decreasing the axial length of the induction heating coils. A temperature sensor 36*a* and 36*b* is associated respectively, with each induction coil 14*a*, 14*b*. Any one of a number of well known devices may be used for temperature sensing, such as for example a pyrometer. After a visual comparison of the readings from temperature sensors 36*a* and 36*b*, an operator may manually adjust the length of either induction coil 14*a* or 14*b* accordingly.

In the embodiment shown in FIGS. 1–3 of the drawings, the axial length of induction coil 14*a* is fixed, by permanent securing of first and second circular ends 22 and 26. In this regard, induction coil 14*a* is a reference coil providing an unchanging reference temperature to which the temperature of the remaining coils are compared. Second circular end 26 of remaining induction coil 14*b* is also permanently secured while first circular end 22 is arranged for manual linearly infinite adjustment within a given range of movement. It will be appreciated therefore that the displacement of first end 22 of induction heating coil 14*b* relative to fixed end 26 thereof provides for increasing or decreasing the axial length of induction heating coil 14*b*. Movement of first circular end 22 of coil 14*b* to the left or right, as viewed in FIG. 1, results in the lengthening or shortening of the coil, respectively. The solid line position of conductor 20 of coil 14*b* in FIG. 1 depicts the relative positions of the adjacent convolutions of coil 14*b* when first circular end 22 is moved to a left extreme. Extreme right positioning of first circular end 22 of the induction heating coil is depicted by the phantom line showing of conductor 20 of the induction heating coil.

As will be seen from FIG. 1, the distance between adjacent convolutions of coil 14*b* changes unequally, although arithmetically, in response to displacement of first circular end 22 in axially opposite directions. In this regard, the distance between the left extreme position and right extreme position of the leftmost convolution 40 is indicated by reference character "a", the corresponding distance "b" for the second leftmost convolution 42 is a smaller distance than "a". Similarly, the distance between leftmost and rightmost positions of the third convolution 44, indicated by reference character "c", is less than either distances "a" or "b". The spacing between leftmost and rightmost positions of the fourth convolution 46, indicated by reference character "d", is likewise less than distances "a", "b" or "c", and the spacing between leftmost and rightmost positions of the fifth convolution 48, indicated by references character "e", is likewise less than distances "a", "b", "c", or "d". Since second circular end 26 of coil 14*b* is fixed, the rightmost convolution 50 is fixed in position and, therefore, the distance between leftmost and rightmost positioning of convolution 50, indicated by reference character "f", is equal to zero.

The adjustment of the axial length of induction coil 14*b* is such that, when the temperature detected by sensor 36*b* is greater than that detected by sensor 36*a*, the operator manually moves first circular end 22 to the right (in FIG. 1). Conversely, when the temperature detected by sensor 36*b*, the operator moves first circular end 22 to the left in FIG. 1. While manual movement of the first end of coil 14*b* is sufficient to constitute effective operation of the furnace according to the invention, the increasing and decreasing of the axial length of the induction coil may be desired to be undertaken automatically.

In accordance with a preferred embodiment of the present invention, automated altering of the axial length of induction coil 14*b* is accomplished through use of a control device, generally indicated by reference numeral 54 in FIG. 1. With temperature sensors 36*a* and 36*b* positioned to enable detection of the temperatures of workpieces 12*a*, 12*b* within the respective induction heating coils, a comparator circuit 56 included in control device 54 receives output signals from temperature sensors 36*a* and 36*b* through appropriate electrical connections. Comparator circuit 56 performs comparing operations between the detected temperatures of respective workpieces 12*a*, 12*b*. In the embodiment shown, induction heating coil 14*a* is the control or reference coil, whereby it will be appreciated that the temperature sensed by sensor 36*a* is the reference temperature signal for the comparator circuit and the temperature signal from sensor 36*b* is compared to the temperature signal from sensor 36*b*.

In the event that the temperatures detected by sensors 36*a* and 36*b* are not identical, the present invention achieves equality of temperatures through the intentional altering of the length of induction coil 14*b*. In the embodiment shown in FIG. 1 of the drawings, the axial length of reference coil 14*a* is fixed, and control device 54 includes a drive mechanism 60*a* for varying the axial length of coil 14*b*. More particularly in this respect, second end 26 of coil 14*b* is fixed as explained above and drive mechanism 60*a* is mechanically connected to first end 22 of induction heating coil 14*b*. Drive mechanism 60*a* is operable to vary the axial length of coil 14*b*. It will be appreciated of course that the displacement of first end 22 of induction heating coil 14*b*, relative to fixed second end 26 thereof provides for increasing or decreasing the axial length of the induction heating coil. Induction heating coil 14*b* has a ring member 62 securely attached to each of first and second circular ends 22 and 26 thereof. A stub shaft 64 extends perpendicularly outward from each ring member 62 and is permanently secured thereto. Attached to the free end of each stub shaft 64 is a flange 66 and, as best seen in FIGS. 2 and 3, a threaded shaft 68 extends axially concentric with stub shaft 64 at end 22 of coil 14*b*. Threaded shaft 68 has a first end threadably engaged with a gear 70 secured to the output shaft of a motor 72, and a second end to which a flange 74 is permanently secured. Flange 74 is coaxial with flange 66 on stub shaft 64, and flanges 66 and 74 are secured together by bolts 76. At second circular end 26 of coil 14*b*, a stub shaft 78 extends axially concentric with stub shaft 64. Stub shaft 78 has a first end permanently secured to a fixed frame portion of furnace 10, and a second end provided with a flange 80 permanently secured thereto. Flange 80 is axially aligned with the corresponding flange 66 on stub shaft 64, and flanges 66 and 80 are secured together by bolts 82.

Motor 72 is provided with electrical power through leads 86 and 88 which may conveniently connect to power source 16 of any other suitable power supply. Motor 72 is a reversibly operable motor, functional to drive threaded shaft 68 and thus the corresponding ring member 62 to the left or to the right, as viewed in FIG. 1. The driving of shaft 68 to the left or to the right causes ring member 62 and thus first circular end 22 of induction heating coil 14*b* to likewise move to the left or right, respectively. The solid line position of conductor 20 of coil 14*b* in FIG. 1 depicts the relative positions of the adjacent convolutions of coil 14*b* when motor 56 has driven threaded shaft 68 and the corresponding ring member 62 to a left extreme. Extreme right positioning of threaded shaft 68, ring member 62 and thus first circular end 22 of the induction heating coil is depicted by the phantom line showing of conductor 20 of the induction heating coil.

Motor 72 which drives member ring 62 and thus first circular end 22 of induction heating coil 14*b* is controlled for direction and extent of drive by comparator circuit 56. In this respect, if the temperature detected by sensor 36*b* is greater than that detected by sensor 36*a*, comparator circuit 56 produces a signal indicating negative correction which is provided to a motor 72 through a lead 90. Conversely, if sensor 36*b* detects a lower temperature than sensor 36*a*, comparator circuit 56 produces a positive correction signal provided to motor 72 through a lead 92. In the case of sensor 36*b* detecting a higher temperature, the negative correction signal provided to motor 72 causes threaded shaft 68 to move to the right as shown in FIG. 1 resulting in ring member 62 and thus end 22 of the induction heating coil being driven to the right. Conversely, when sensor 36*b* detects a lower temperature, the positive correction signal provided to motor 72 causes threaded shaft 68 to be driven to the left as shown in FIG. 1, thus driving ring member 62 and end 22 of the induction heating coil to the left. Movement of end 22 of the induction heating coil to the left as shown in FIG. 1 causes the axial length of the induction heating coil 14*b* to be extended. This extension of the axial length results in a lowering of the magnetic flux of induction coil 14*b* upon workpiece 12*b* within the circular passage of the induction heating coil. Shortening of the axial length of induction heating coil 14*b* by movement of end 22 to the right increases the magnetic flux impinging upon workpiece 12*b*. As noted above, when the magnetic flux is decreased, the heat generated within the workpiece is increased. Likewise, when the magnetic flux is increased by decreasing the length of induction heating coil 14*b*, the heat within the workpiece is decreased.

While certain of the components of control device 54 are known in the art, some discussion thereof is appropriate. In this regard, some degree of correlation between temperature sensors 36*a*, 36*b* and comparator circuit 56 is required. The output of comparator circuit 56 can be either an analog or digital signal, requiring motor 72 to be correspondingly responsive to analog or digital signals. Generally, economic factors dictate that digital signals be used as opposed to analog signals. In this regard, sensors 36*a*, 36*b* are desired to provide instantaneous temperature readings of workpieces 12*a*, 12*b*. Comparator circuit 56 is therefore required to provide gating for sensors 36*a*, 36*b* in order that the output signals indicating the instantaneous temperatures of the respective workpieces be provided to the comparator circuit at precisely the same time. Through the use of the digital responsive control device 54, any correction for difference in temperature between workpieces 12*a*, 12*b* would occur instantaneously as opposed to continuously. Control device 54 might also include timing or clock provisions wherein the comparison of detected temperatures would occur repetitively throughout the heating of workpieces 12*a*, 12*b*.

While the parallel induction heating coil furnace 10, as shown in FIG. 1, includes only two induction heating coils 14*a*, 14*b* and therefore accommodates only two workpieces 12*a*, 12*b*, the present invention is not limited to the use of only two of the induction heating coils. In this regard, any number of the induction heating coils may be provided in parallel arrangement similar to that shown in FIG. 1 to accommodate a plurality of workpieces. FIG. 4 illustrates an induction heating furnace 110 wherein like reference numerals are used to indicate components thereof similar to the furnace in FIG. 1. Furnace 110 is provided with three induction heating coils 114*a*, 114*b* and 114*c* for accommodating three workpieces 112*a*, 112*b*, 112*c*. As in the case of furnace 10, each induction heating coil 114*a*, 114*b*, 114*c* is comprised of conductor 20 coiled into a number of adjacent convolutions providing each coil with a first circular end 22 and a second circular end 26. First end 22 of each of the induction heating coils is connected to power source 16 through electrical lead 24, and second end 26 of each of the induction heating coils is connected to power source 16 through electrical lead 28. Rails 34 provided through the circular passage of each of the induction heating coils support the workpieces moving through the circular passages.

In the case of three induction heating coils 114*a*, 114*b*, 114*c* as shown in FIG. 4, control device 54 is modified to include an additional sensor 36*c* and a second drive mechanism 60*b*, which is identical to drive mechanism 60*a* except for the control signals to the corresponding motor 72 of mechanism 60*b* as set forth hereinafter. As in the case of furnace 10, a ring member 62 is secured to each of the ends 22 and 26 of the induction heating coils 114*b*, 114*c* and first ends 22 of the two coils are displacable in the axial direction by the corresponding drive motor 72 and threaded shaft 68. Each motor 72 is controlled by comparator circuit 56 to lengthen or shorten the axial length of induction heating coils 114*b*, 114*c* as described above. More particularly, induction heating coil 114*a* is considered the control or reference coil corresponding to coil 14*a* in FIG. 1, whereby sensor 36*a* provides the reference signal for comparator circuit 56. Comparator circuit 56 individually compares the temperatures sensed by sensors 36*b* and 36*c* to that sensed by sensor 36*a*, and provides individual control signals to drive motors 72 of drive mechanisms 60*a* and 60*b*. In this regard, while the temperature sensed by sensor 36*c* might be high with respect to the temperature at sensor 36*a*, requiring drive mechanism 60*a* to decrease the axial length of induction heating coil 114*b*, the temperature detected by sensor 36*c* might well be low requiring drive mechanism 60*b* to increase the axial length of induction heating coil 114*c*.

Figure 5:
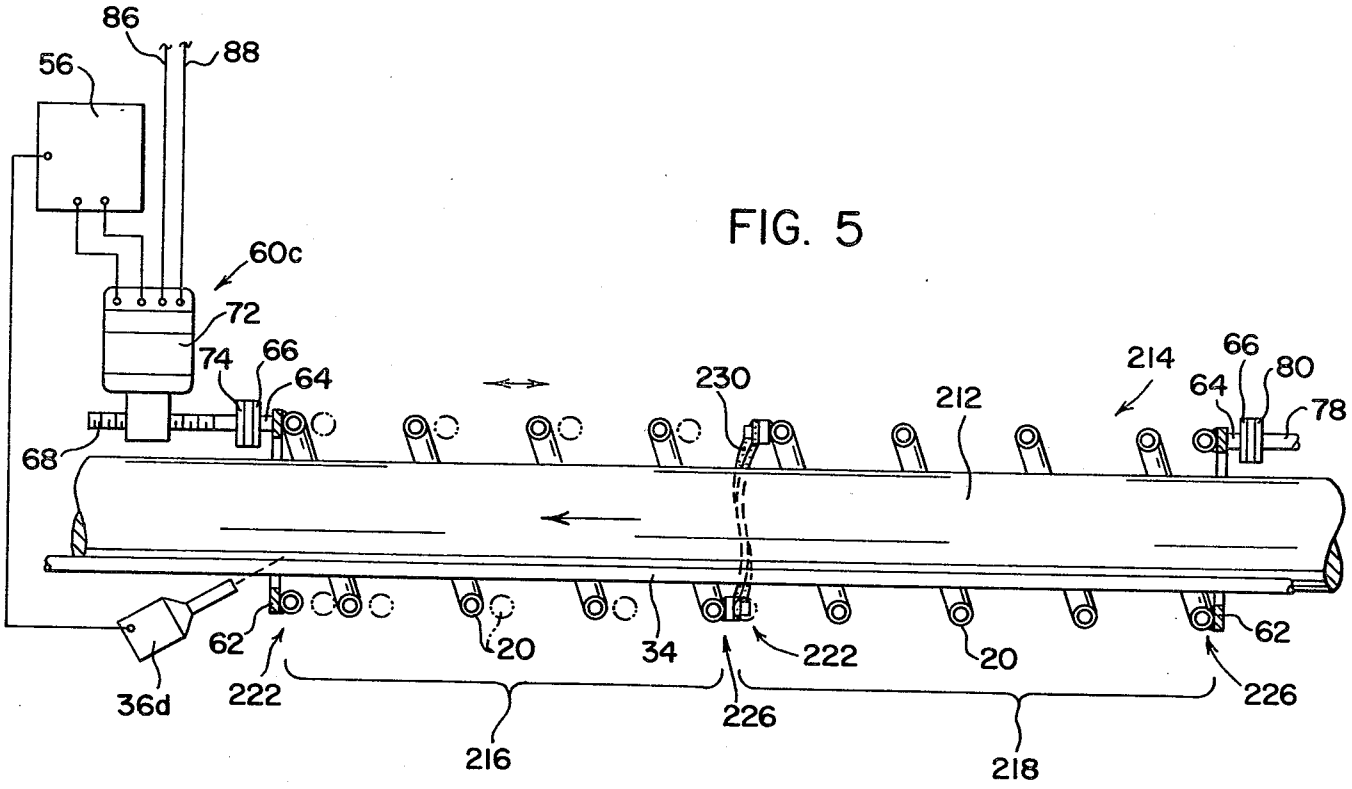

Another arrangement for varying the axial length of the induction coil is depicted in FIG. 5, wherein like reference numerals indicate components which are similar to those identified and discussed above. A workpiece 212 is shown movably extending through an alternate induction coil 214 on rails 34. Induction coil 214 includes first and second induction portions, 216 and 218, respectively, each comprised of electrical conductor 20 coiled into a number of adjacent convolutions providing each with first and second circular ends, 222 and 226, respectively. First and second coil portions 216 and 218 are electrically, serially connected at adjacent second end 226 of first portion 216 and first end 222 of second portion 218. The electrical connection of the first and second portions is accomplished through a flexible conducting member 230. Any suitable method of providing flexibility and conductivity between the portions of induction coil 214 is acceptable in the construction of conducting member 230.

Second end 226 of second coil portion 218 is fixedly secured to a stationary frame member (not shown) by shaft 78. As discussed above stub shaft 78 is permanently attached to flange 80 which is in turn releasably secured to corresponding flange 66. Flange 66 is permanently secured to second end 226 of coil portion 218 by stub shaft 64 attached to ring 62. First end 222 of first coil portion 216 is provided with an arrangement for being adjustably moved relative to the second end of coil portion 218, such as for example an automatic drive mechanism 60*c*. Drive mechanism 60*c* is identical to mechanisms 60*a* and 60*b* discussed above and includes motor 72 drivingly engaging threaded shaft 68 which laterally moves ring 62 attached to first end 222 of the first coil portion. The connection of threaded shaft 68 to ring 62 is accomplished releasably through corresponding flanges 66 and 74.

A temperature sensor 36*d* detects the temperature of workpiece 212 and produces a signal used by comparator circuit 56 to determine if adjustment of the axial length of coil 214 is required. In the event that adjustment is necessary, driving threaded shaft to the left, as shown in FIG. 5, lengthens coil 214 and thus increases the temperature of workpiece 212. Conversely, driving the shaft to the right shortens the coil and results in the temperature decreasing. The separate convolutions of each coil portion 216 and 218 are fixed relative to one another requiring entire coil portion 216 to move relative to entire coil portion 218 when drive mechanism 60*c* operates. Flexible connection 230 provides for the difference in total length of coil 214. The solid line convolutions of coil portion 216 indicate movement to the extreme left by drive mechanism 60*c*, while the phantom line convolutions indicate movement to the extreme right.

While considerable emphasis have been placed herein on preferred embodiments of the invention and the specific structures and structural relationships of the component parts thereof, particularly with regard to either two or three induction heating coils, it will be readily apparent that many embodiments of the invention can be made, and that many changes can be made in the embodiments herein illustrated and described without departing from the principles of the invention. Especially, it will be appreciated that a furnace can be provided with a plurality of induction heating coils in excess of three. Accordingly, it is to be distinctly understood that the foregoing descriptive matter is to be interpreted merely as illustrative of the invention and not as a limitation.

I claim:

1. In an induction heating furnace for heating at least two elongated workpieces simultaneously to predetermined temperatures including at least two elongated induction heating coils each formed from helical, spaced convolutions and having a workpiece receiving passage through which one of the workpieces moves, axial opposite ends and two electrical connections, a single power source for energizing said induction coils across the electrical connections of said induction coils, the improvement comprising: means for changing the convolution spacing of at least one of said induction coils by moving said opposite ends relative to one another whereby the temperature of the workpiece within the one said passage is adjusted relative to the temperature of a workpiece in another said passage.

2. The improvement according to claim 1 including means for supporting the axial opposite ends of said one induction coil for axial displacement of a first of said ends relative to a second of said ends.

3. The improvement according to claim 2 including drive means for moving said first end relative to said second end of said one induction coil.

4. The improvement according to claim 1, wherein another of said induction coils has said axial opposite ends fixed relative to one another.

5. The improvement according to claim 3 including sensor means for monitoring temperatures of workpieces within passages of said induction coils, said drive means responding to said sensor means.

6. The improvement according to claim 5 wherein another induction coil has said axial opposite ends fixed relative to one another.

7. The improvement according to claim 3, wherein said drive means displaces said first end of said one induction coil in the direction to extend said one induction coil when the temperature of a workpiece in said other induction coil is higher than the temperature of a workpiece in said one induction coil and displaces said first end of said one induction coil in the direction of contract said one induction coil when the temperature of a workpiece in said other induction coil is lower than the temperature of a workpiece in said one induction coil.

* * * * *